US009467762B2

(12) United States Patent
Huang et al.

(10) Patent No.: US 9,467,762 B2
(45) Date of Patent: Oct. 11, 2016

(54) EARPHONE DEVICE HAVING SOUND GUIDING STRUCTURES

(71) Applicant: Jetvox Acoustic Corp., Taoyuan (TW)

(72) Inventors: Ying-Shin Huang, Taoyuan (TW); To-Teng Huang, Taoyuan (TW)

(73) Assignee: JETVOX ACOUSTIC CORP., Taoyuan (TW)

( * ) Notice: Subject to any disclaimer, the term of this patent is extended or adjusted under 35 U.S.C. 154(b) by 0 days.

(21) Appl. No.: 14/678,689

(22) Filed: Apr. 3, 2015

(65) Prior Publication Data

US 2016/0205458 A1 Jul. 14, 2016

(30) Foreign Application Priority Data

Jan. 14, 2015 (TW) ..... 104200608 A

(51) Int. Cl.

| | |
|---|---|
| ***H04R 25/00*** | (2006.01) |
| ***H04R 1/10*** | (2006.01) |
| ***H04R 1/24*** | (2006.01) |
| ***H04R 9/06*** | (2006.01) |
| ***H04R 5/033*** | (2006.01) |

(52) U.S. Cl.

CPC ..... *H04R 1/1016* (2013.01); *H04R 1/1075* (2013.01); *H04R 1/24* (2013.01); *H04R 5/033* (2013.01); *H04R 9/063* (2013.01); *H04R 2205/022* (2013.01); *H04R 2209/026* (2013.01)

(58) Field of Classification Search

CPC H04R 1/1008; H04R 1/1016; H04R 1/1075; H04R 1/24; H04R 1/26; H04R 5/033; H04R 9/06; H04R 9/063; H04R 2209/026; H04R 2201/105; H04R 2205/022

USPC ..... 381/309, 345, 349, 182, 186, 370, 371, 381/373, 380; 379/430, 433.02, 432; 181/129, 135, 144

See application file for complete search history.

(56) References Cited

U.S. PATENT DOCUMENTS 4,418,248 A * 11/1983 Mathis ..... H04R 1/26 381/190
4,965,836 A * 10/1990 Andre ..... H04R 1/1008 181/129
8,300,871 B2 * 10/2012 Welsh ..... H04R 1/1075 381/182

* cited by examiner

*Primary Examiner* — Huyen D Le
(74) *Attorney, Agent, or Firm* — Muncy, Geissler, Olds & Lowe, P.C.

(57) ABSTRACT

An earphone device having sound guiding structures includes a housing, a sound guiding cover, a first speaker unit, and a second speaker unit. The housing includes a shell and an acoustic opening. The sound guiding cover is in the shell and includes a front and a rear guide portions. The front guide portion is close to the acoustic opening. The front guide portion includes a first accommodating portion and a guide tube communicating with the first accommodating portion and extending toward the acoustic opening. A guide passage is defined between the front guide portion and the shell. The rear guide portion is away from the acoustic opening relative to the front guide portion. The rear guide portion includes a second accommodating portion communicating with the guide passage. The first speaker unit is in the first accommodating portion. The second speaker unit is in the second accommodating portion.

16 Claims, 5 Drawing Sheets

EARPHONE DEVICE HAVING SOUND GUIDING STRUCTURES

CROSS-REFERENCES TO RELATED APPLICATIONS

This non-provisional application claims priority under 35 U.S.C. §119(a) on Patent Application No. 104200608 filed in Taiwan, R.O.C. on 2015 Jan. 14, the entire contents of which are hereby incorporated by reference.

BACKGROUND

1. Technical Field

The instant disclosure relates to a speaker, and more particularly, to an earphone device having sound guiding structures.

2. Related Art

Sound-producing devices, such as earphones, loudspeakers, and voice boxes, are pretty common products on the market. People can feel relaxing and entertaining by listening and enjoying music produced by these sound-producing devices.

Nevertheless, consumers pay more and more attention on sound qualities along with the improvement of technologies. In order to have better sound qualities, most of sound-producing devices install different transducers which are respectively responsible for producing different ranges of sound frequencies. The transducers, such as treble speaker units and woofer speaker units, are designed for properly producing corresponding ranges of sound frequencies. As a result, the sound qualities of the sound-producing devices including different transducers can be improved.

Sounds produced by the transducers responsible for different ranges of sound frequencies have different wavelengths. Therefore, the configurations in terms of the structures of the treble speaker units and woofer speaker units in sound-producing devices are very important. Such configurations are key factors for decreasing the interference between different wavelengths or frequencies of sounds.

SUMMARY

To address the above issue, the instant disclosure provides an earphone device having sound guiding structures which includes a housing, a sound guiding cover, a first speaker unit, and a second speaker unit. The housing includes a shell and an acoustic opening being at a side of the shell. The sound guiding cover is disposed in the shell and includes a front guide portion and a rear guide portion. The front guide portion is close to the acoustic opening. The front guide portion includes a first accommodating portion and a guide tube communicating with the first accommodating portion and extending toward the acoustic opening. There is a guide passage which is defined between the front guide portion and the shell. The rear guide portion is away from the acoustic opening relative to the front guide portion. The rear guide portion includes a second accommodating portion. The second accommodating portion communicates with the guide passage. The first speaker unit is disposed in the first accommodating portion. The second speaker unit is disposed in the second accommodating portion. The first speaker unit can be a treble speaker unit, and the second speaker unit can be a woofer speaker unit.

The instant disclosure has a configuration that the first speaker unit and the second speaker unit are respectively disposed in the first accommodating portion and the second accommodating portion. Therefore, the sounds produced by the first speaker unit can be guided and transported through the guide tube toward the acoustic opening, and the sounds produced by the second speaker unit can be guided and transported through the guide passage toward the acoustic opening. As a result, the sounds produced by the first speaker unit and the sounds produced by the second speaker unit do not interfere with each other when transporting in the earphone device. The instant disclosure also has a configuration that the guide tube further extends toward the acoustic opening. Therefore, the sounds respectively produced by the first speaker unit and the second speaker unit do not combine with each other until they are close enough to the location of the acoustic opening. Once the sounds having different wavelengths and frequencies combine with each other, the sounds are easily interfered. By delaying the timing with which the sounds combine, the period of the time of the interference can be further decreased. As a result, the qualities of the sounds produced by the earphone device are improved.

According to an embodiment of the instant disclosure, the first speaker unit includes an acoustic cavity and a cavity opening formed on a side of the acoustic cavity. The cavity opening is aligned with the guide tube. The sounds produced by the first speaker unit can be guided and directly transported through the cavity opening into the guide tube.

According to an embodiment of the instant disclosure, the housing further includes an acoustic passage formed on a side of the housing and contracted in a radial direction. The acoustic opening is formed at an end of the acoustic passage. The guide tube is disposed in the acoustic passage and includes a tube opening. The tube opening is close to the acoustic opening. In an embodiment, the acoustic opening of the housing and the tube opening are substantially formed at a same plane. Therefore, the sounds respectively produced by the first speaker unit and the second speaker unit can combine with each other at the location of the acoustic opening. As a result, the period of the time of the interference can be further decreased, and the qualities of the sounds produced by the earphone device are improved.

According to an embodiment of the instant disclosure, the front guide portion further includes a front wall facing toward the acoustic opening and a surrounding wall connected to a periphery of the front wall. The guide tube is located at a center of the front wall. The first accommodating portion is formed at inner sides of the front wall and the surrounding wall.

According to an embodiment of the instant disclosure, a width of the rear guide portion can be greater than that of the front guide portion. The rear guide portion further includes an extending wall and an outer surrounding wall. The extending wall is connected to a rear side of the first accommodating portion in a radial direction and faces toward the acoustic opening. The outer surrounding wall is connected to a periphery of the extending wall. The second accommodating portion is formed at inner sides of the extending wall and the outer surrounding wall. Furthermore, the extending wall includes at least a guide hole, and the guide hole communicates with the guide passage. The sounds produced by the second speaker unit in the second accommodating portion can be guided and transported through the guide hole into the guide passage.

According to an embodiment of the instant disclosure, the second speaker unit can include a speaker diaphragm. Sound waves can be produced by the vibration of the speaker diaphragm. Furthermore, the second speaker unit is assembled to the first speaker unit.

These and other objectives of the instant disclosure will no doubt become obvious to those of ordinary skill in the art after reading the following detailed description of the preferred embodiment that is illustrated in the various figures and drawings.

DETAILED DESCRIPTION

Figure 1:
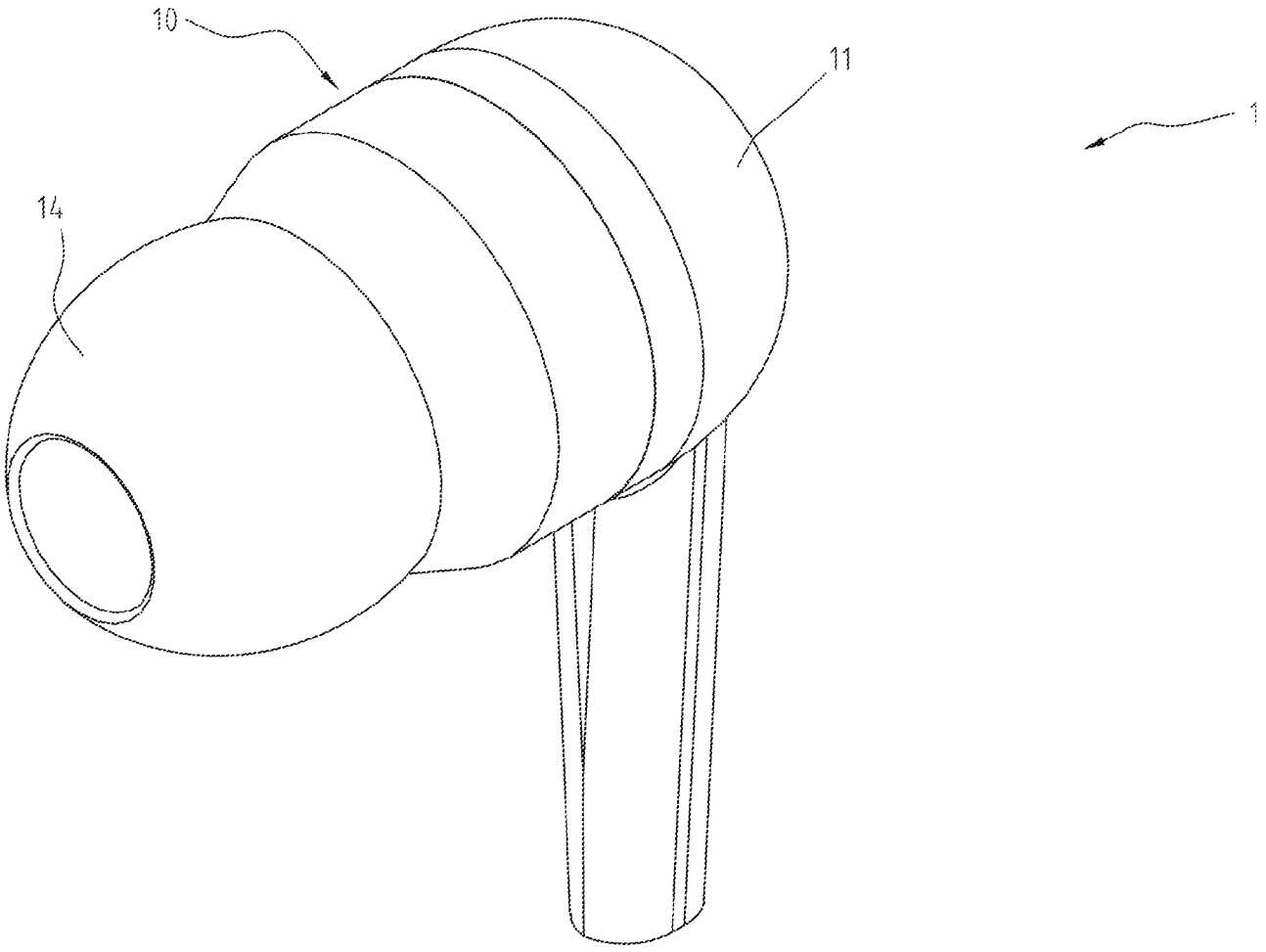
FIG. 1 illustrates a perspective view of an earphone device having sound guiding structures according to an embodiment of the instant disclosure.
Figure 2:
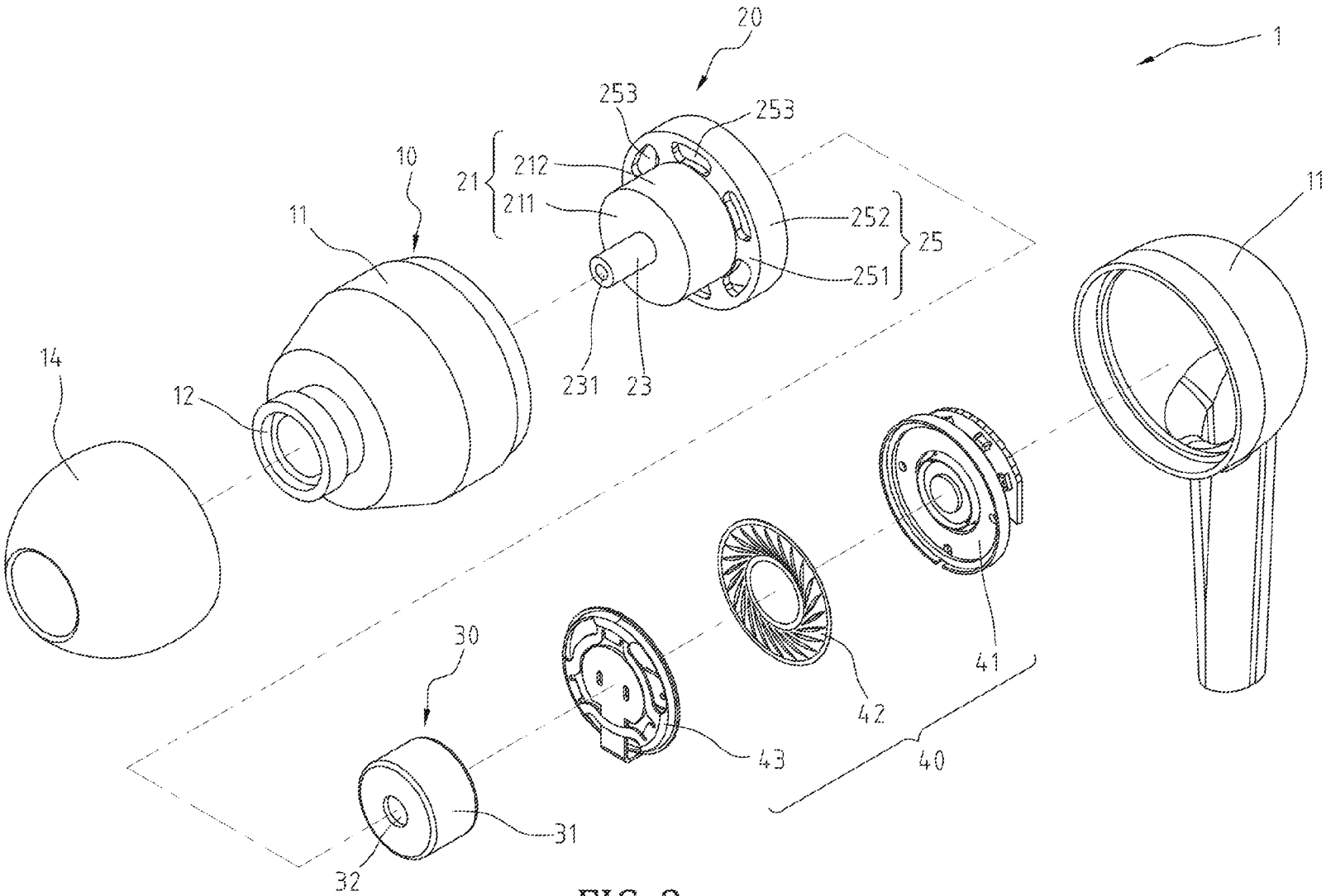
FIG. 2 illustrates an exploded view of the earphone device according to the embodiment of the instant disclosure.
Figure 3:
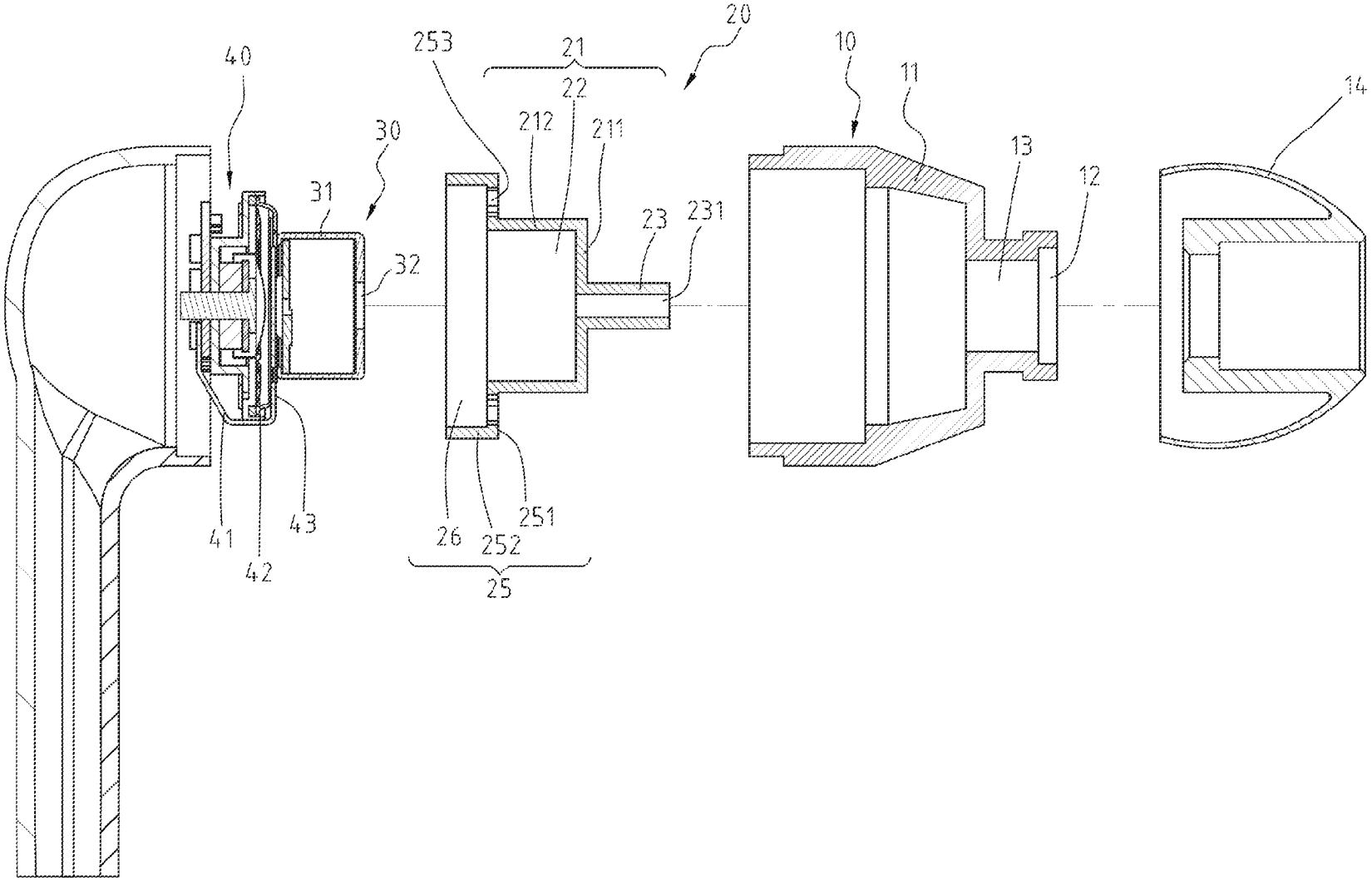
FIG. 3 illustrates a cross-sectional view of the earphone device in an exploded state according to the embodiment of the instant disclosure.

Referring to FIG. 1, FIG. 2, and FIG. 3, FIG. 1 to FIG. 3 respectively illustrate a perspective view, an exploded view, and a cross-sectional view of an earphone device 1 having sound guiding structures according to an embodiment of the instant disclosure. The earphone device 1 having sound guiding structures includes a housing 10, a sound guiding cover 20, a first speaker unit 30, and a second speaker unit 40. The sound guiding structures for guiding sounds produced by the first and the second speaker units 30, 40 are defined by the housing 10 and the guiding cover 20. The housing 10 is a hollow body. The housing 10 is of assembly, as shown in FIG. 2. The housing 10 includes a shell 11 and an acoustic opening 12 formed at a side of the shell 11. One side of the housing 10 is contracted in a radial direction to form an acoustic passage 13 which communicates with outside. The acoustic opening 12 is formed at an end of the acoustic passage 13. An earplug 14 is around and assembled to an outer side of the acoustic opening 12. The earplug 14 can be plug into an auditory meatus of a user such that the sounds produced by the earphone device 1 can be transported to the user.

The sound guiding cover 20 is a hollow cover. The sound guiding cover 20 is disposed in an inner side of the housing 10. The sound guiding cover 20 can be adhered to, embedded in, or fastened to an inner side of the shell 11. The sound guiding cover 20 includes a front guide portion 21 and a rear guide portion 25. The front guide portion 21 is close to the acoustic opening 12. The front guide portion 21 includes a first accommodating portion 22 and a guide tube 23. The front guide portion 21 further includes a front wall 211 facing toward the acoustic opening 12 and a surrounding wall 212 connected to a periphery of the front wall 211. The front wall 211 and the surrounding wall 212 corporately form a cylindrical cover. The first accommodating portion 22 is formed at inner sides of the front wall 211 and the surrounding wall 212. In other words, the first accommodating portion 22 is the space formed by the cylindrical cover. The guide tube 23 is a cylindrical tube, and is located at a center of the front wall 211. The guide tube 23 communicates with the first accommodating portion 22 and extends toward the acoustic opening 12.

Figure 4:
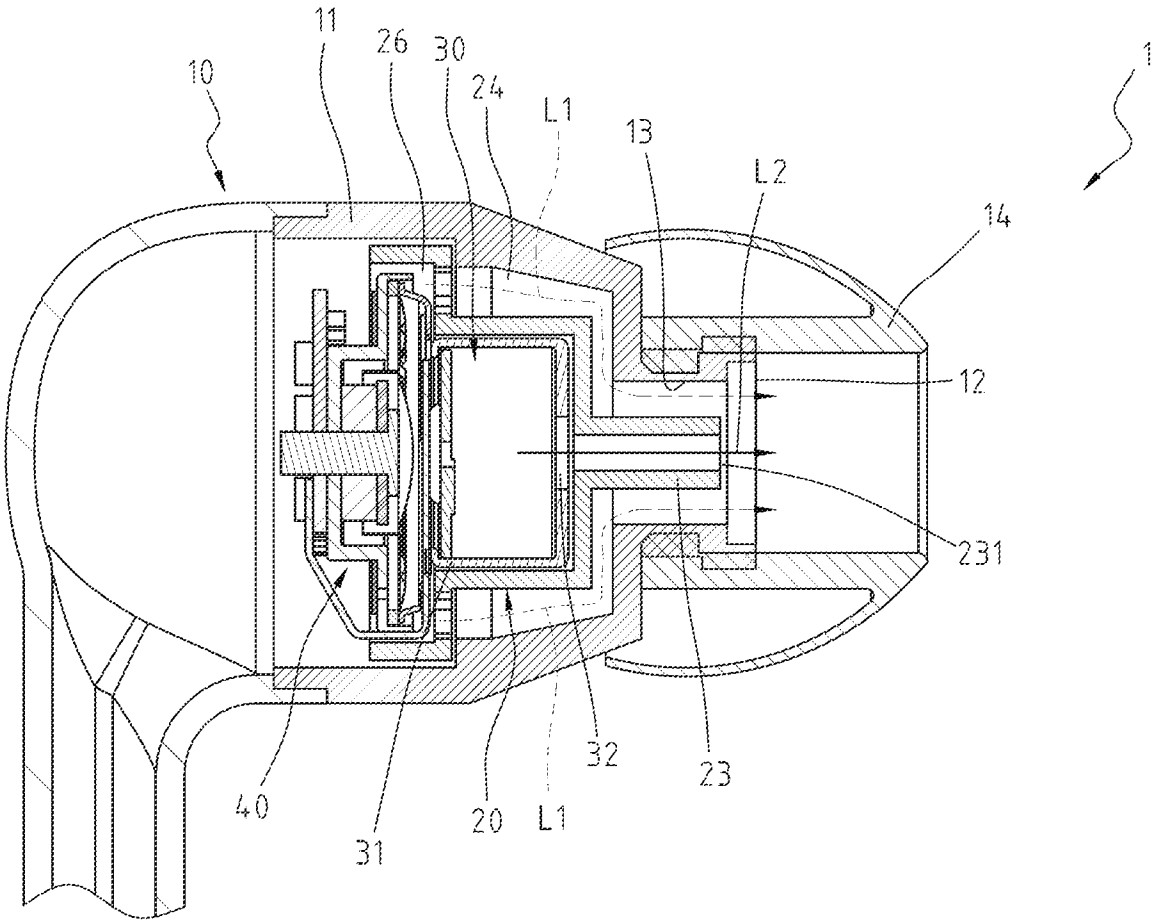
FIG. 4 illustrates a cross-sectional view of the earphone device in an assembled state according to the embodiment of the instant disclosure.

Referring to FIG. 4, FIG. 4 illustrates a cross-sectional view of the earphone device 1 in an assembled state according to the embodiment of the instant disclosure. There is an interval between the front guide portion 21 and the shell 11. The interval defines a guide passage 24 having an annular shape. Namely, the guide passage 24 is defined between the front guide portion 21 and the shell 11. The guide tube 23 is disposed in the acoustic passage 13. The guide tube 23 includes a tube opening 231 formed at an end thereof. The tube opening 231 is close to the acoustic opening 12. The guide passage 24 communicates with the acoustic opening 12, which allows the sounds can be transported through the guide passage 24 and the acoustic opening 12 to the outside.

The rear guide portion 25 is a cylindrical cover, and is axially aligned with the front guide portion 21. The rear guide portion 25 is away from the acoustic opening 12 relative to the front guide portion 21. In addition, a width of the rear guide portion 25 is greater than that of the front guide portion 21. In other words, the diameter of the rear guide portion 25 is greater than that of the front guide portion 21. The rear guide portion 25 includes an extending wall 251, an outer surrounding wall 252, and a second accommodating portion 26. The extending wall 251 is connected to a rear side of the first accommodating portion 22 in a radial direction, and faces toward the acoustic opening 12. The outer surrounding wall 252 is connected to a periphery of the extending wall 251. The second accommodating portion 26 is formed at inner sides of the extending wall 251 and the outer surrounding wall 252. The second accommodating portion 26 communicates with the first accommodating portion 22. In addition, the extending wall 251 includes a plurality of guide holes 253, and the guide holes 253 respectively communicate with the guide passage 24. In the embodiment, the guide holes 253 are equiangularly arranged and are arrayed in an annular aspect, as shown in FIG. 2.

In the embodiment, as shown FIG. 4, the first speaker unit 30 can be a treble speaker unit and is disposed in the first accommodating portion 22 of the front guide portion 21. In the embodiment, the first speaker unit 30 includes an acoustic cavity 31 and a cavity opening 32. The acoustic cavity 31 is a cylindrical cavity. A wall of the acoustic cavity 31 is adjacent to the front wall 211 and the surrounding wall 212 of the first accommodating portion 22. The cavity opening 32 is formed on a side of the acoustic cavity 31, and is aligned with the guide tube 23. Therefore, the sounds produced by the first speaker unit 30 can be guided and transported through the guide tube 23 toward the acoustic opening 12. In other words, the cavity opening 32 communicates with a passage inside the guide tube 23.

The second speaker unit 40 can be a woofer speaker unit and is disposed in the second accommodating portion 26 of the rear guide portion 25. The sounds produced by the second speaker unit 40 can be guided and transported through the guide holes 253 of the extending wall 251 into the guide passage 24 toward the acoustic opening 12. The second speaker unit 40 includes a base bracket 41, a speaker diaphragm 42, and a cover body 43. The speaker diaphragm 42 is assembled between the base bracket 41 and the cover body 43. The second speaker unit 40 produces sound waves by the vibration of the speaker diaphragm 42. The base bracket 41 may be installed with components such as a conductive plate, a magnet, a voice coil, and a circuit board. These components shall be known by the person of ordinary skill in the art, and there is no need for detailed description. In addition, the cover body 43 of the second speaker unit 40 is assembled to the first speaker unit 30.

Referring to the FIG. 4, the first speaker unit 30 is, but is not limited to, a treble speaker unit, and the second speaker unit 40 is, but is not limited to, a woofer speaker unit. The second speaker unit 40 produces sound waves with low frequencies by the vibration of the speaker diaphragm 42. The sound waves with low frequencies can be guided and transported through the guide holes 253 of the rear guide portion 25 into the guide passage 24, and be further transported through the acoustic opening 12 (as shown by the arrow L1 in FIG. 4). The sound waves with high frequencies produced by the first speaker unit 30 can be guided and transported through the guide tube 23, and be further transported through the acoustic opening 12 (as shown by the arrow L2 in FIG. 4). As a result, the sound waves with different ranges of frequencies respectively produced by the first speaker unit 30 and the second speaker unit 40 do not interfere with each other when transporting in the earphone device 1. The qualities of the sounds produced by the earphone device 1 are improved.

In addition, the instant disclosure has a configuration that the guide tube 23 further extends toward the acoustic opening 12. Therefore, the sounds respectively produced by the first speaker unit 30 and the second speaker unit 40 do not combine with each other until they are close enough to the location of the acoustic opening 12. Once the sounds having different wavelengths and frequencies combine with each other, the sounds are easily interfered. By delaying the timing with which the sounds combine, the period of the time of the interference can be further decreased. As a result, the qualities of the sounds produced by the earphone device 1 are improved.

Figure 5:
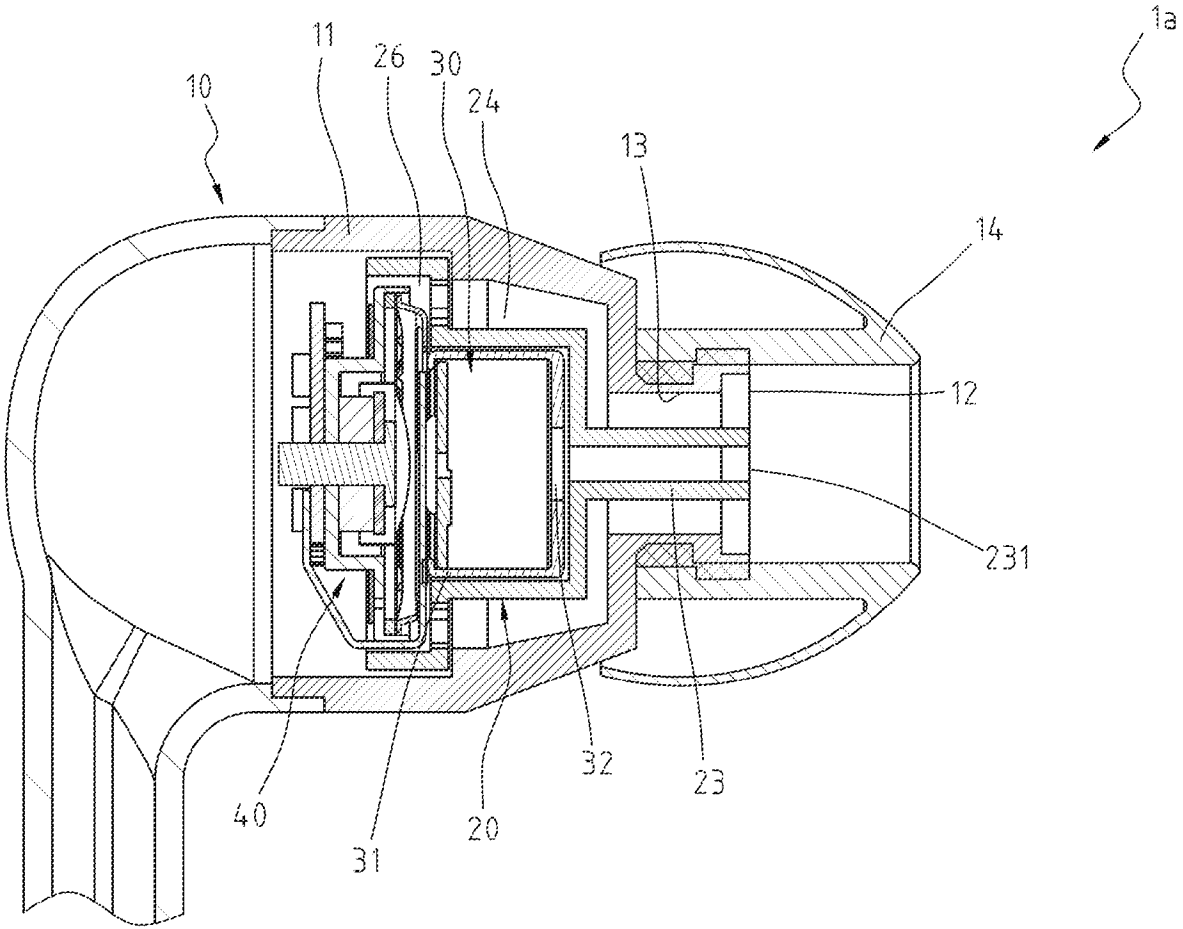
FIG. 5 illustrates a cross-sectional view of an earphone device having sound guiding structures according to another embodiment of the instant disclosure.

Referring to FIG. 5, FIG. 5 illustrates a cross-sectional view of an earphone device 1*a* having sound guiding structures according to another embodiment of the instant disclosure. In the embodiment, the tube opening 231 of the guide tube 23 and the acoustic opening 12 of the housing 10 of the earphone device 1*a* are substantially formed at a same plane. Therefore, the sounds respectively produced by the first speaker unit 30 and the second speaker unit 40 can combine with each other at the location of the acoustic opening 12. As a result, the period of the time of the interference can be further decreased, and the qualities of the sounds produced by the earphone device 1*a* are further improved. In short, if the tube opening 231 of the guide tube 23 is closer to the acoustic opening 12 of the housing 10, the sounds respectively produced by the first and the second speakers 30, 40 have less interference.

While the instant disclosure has been described by way of example and in terms of the preferred embodiments, it is to be understood that the instant disclosure needs not be limited to the disclosed embodiments. For anyone skilled in the art, various modifications and improvements within the spirit of the instant disclosure are covered under the scope of the instant disclosure. The covered scope of the instant disclosure is based on the appended claims.

What is claimed is:

1. An earphone device having sound guiding structures, comprising:

a housing comprising a shell and an acoustic opening formed at a side of the shell, the housing further comprising an acoustic passage formed on a side of the housing and contracted in a radial direction, the acoustic opening being formed at an end of the acoustic passage;

a sound guiding cover disposed in the shell and comprising:

a front guide portion being close to the acoustic opening, wherein the front guide portion comprises a first accommodating portion and a guide tube communicating with the first accommodating portion and extending toward the acoustic opening, and a guide passage is defined between the front guide portion and the shell, the guide tube is disposed in the acoustic passage and comprises a tube opening being adjacent to the acoustic opening, and a rear guide portion being away from the acoustic opening relative to the front guide portion, wherein the rear guide portion comprises a second accommodating portion communicating with the guide passage;

a first speaker unit disposed in the first accommodating portion; and a second speaker unit disposed in the second accommodating portion.

2. The earphone device having sound guiding structures of claim 1, wherein the first speaker unit comprises an acoustic cavity and a cavity opening formed on a side of the acoustic cavity, and the cavity opening is aligned with the guide tube.

3. The earphone device having sound guiding structures of claim 1, wherein the acoustic opening of the housing and the tube opening are formed at a same plane.

4. The earphone device having sound guiding structures of claim 1, wherein the front guide portion further comprises a front wall facing toward the acoustic opening and a surrounding wall connected to a periphery of the front wall, the guide tube is located at a center of the front wall, and the first accommodating portion is formed at inner sides of the front wall and the surrounding wall.

5. The earphone device having sound guiding structures of claim 1, wherein the rear guide portion further comprises an extending wall and an outer surrounding wall, the extending wall is connected to a rear side of the first accommodating portion in a radial direction and faces toward the acoustic opening, the outer surrounding wall is connected to a periphery of the extending wall, and the second accommodating portion is formed at inner sides of the extending wall and the outer surrounding wall.

6. The earphone device having sound guiding structures of claim 5, wherein the extending wall comprises at least a guide hole, and the at least a guide hole communicates with the guide passage.

7. The earphone device having sound guiding structures of claim 1, wherein the second speaker unit comprises a speaker diaphragm and the second speaker unit is assembled to the first speaker unit.

8. The earphone device having sound guiding structures of claim 1, wherein the first speaker unit is a treble speaker unit and the second speaker unit is a woofer speaker unit.

9. An earphone device having sound guiding structures, comprising:

a housing comprising a shell and an acoustic opening formed at a side of the shell;

a sound guiding cover disposed in the shell and comprising:

a front guide portion being close to the acoustic opening, wherein the front guide portion comprises a first accommodating portion and a guide tube communicating with the first accommodating portion and extending toward the acoustic opening, and a guide passage is defined between the front guide portion and the shell, and a rear guide portion being away from the acoustic opening relative to the front guide portion, wherein the rear guide portion comprises a second accommodating portion communicating with the guide passage, wherein the rear guide portion further comprises an extending wall and an outer surrounding wall, the extending wall is connected to a rear side of the first accommodating portion in a radial direction and faces toward the acoustic opening, the outer surrounding wall is connected to a periphery of the extending wall, and the second accommodating portion is formed at inner sides of the extending wall and the outer surrounding wall;

a first speaker unit disposed in the first accommodating portion; and a second speaker unit disposed in the second accommodating portion.

10. The earphone device having sound guiding structures of claim 9, wherein the first speaker unit comprises an acoustic cavity and a cavity opening formed on a side of the acoustic cavity, and the cavity opening is aligned with the guide tube.

11. The earphone device having sound guiding structures of claim 9, wherein the housing further comprises an acoustic passage formed on a side of the housing and contracted in a radial direction, the acoustic opening is formed at an end of the acoustic passage, and the guide tube is in the acoustic passage and comprises a tube opening being close to the acoustic opening.

12. The earphone device having sound guiding structures of claim 11, wherein the acoustic opening of the housing and the tube opening are formed at a same plane.

13. The earphone device having sound guiding structures of claim 9, wherein the front guide portion further comprises a front wall facing toward the acoustic opening and a surrounding wall connected to a periphery of the front wall, the guide tube is located at a center of the front wall, and the first accommodating portion is formed at inner sides of the front wall and the surrounding wall.

14. The earphone device having sound guiding structures of claim 9, wherein the extending wall comprises at least one guide hole, and the at least one guide hole communicates with the guide passage.

15. The earphone device having sound guiding structures of claim 9, wherein the second speaker unit comprises a speaker diaphragm and the second speaker unit is assembled to the first speaker unit.

16. The earphone device having sound guiding structures of claim 9, wherein the first speaker unit is a treble speaker unit and the second speaker unit is a woofer speaker unit.

* * * * *